US005299103A

United States Patent [19]

Kielland

[11] Patent Number: 5,299,103

[45] Date of Patent: Mar. 29, 1994

[54] PORTABLE UNDERWATER SWIMMING POOL LIGHT

[76] Inventor: Peter J. Kielland, 310 Selby Ave., Ottawa, Ontario, Canada K1Z6R1

[21] Appl. No.: 917,966

[22] Filed: Jul. 24, 1992

[30] Foreign Application Priority Data

Jul. 29, 1991 [CA] Canada ..... 2048103

[51] Int. Cl.[5] ..... F21V 33/00

[52] U.S. Cl. ..... 362/101; 362/301; 362/342; 362/427

[58] Field of Search ..... 362/101, 96, 301, 302, 362/342, 344, 371, 806, 427

[56] References Cited

U.S. PATENT DOCUMENTS 1,762,383 6/1930 Booraem ..... 362/101 X
1,926,945 9/1933 Hipp, Jr. ..... 362/101 X
5,144,545 9/1992 Klitzing ..... 362/101

*Primary Examiner*—Stephen F. Husar
*Attorney, Agent, or Firm*—S. T. Jelly

[57] ABSTRACT

A portable light fixture which illuminates the volume of water in a swimming pool has the light source and all attendance electrical hardware mounted above the water's surface to avoid the normal measures required to waterproof the light. Light is projected downward into the water through a light shaft which hangs over the edge of the pool and extends down below the water line. The shaft and light element enclosure is opaque. Light travels down the light shaft, traverses the air/water boundary and then exits the light shaft below the water line to a reflective light diffuser suspended within or directly below the shaft exit. The light diffuser spreads the beam away from the pool wall by reflecting the vertical rays exiting the light shaft into a diffuse horizontal beam which then propagates throughout the swimming pool.

14 Claims, 3 Drawing Sheets

PORTABLE UNDERWATER SWIMMING POOL LIGHT

This invention relates to a portable underwater light for both in-ground and above-ground swimming pools. Underwater pool lighting serves two purposes: it beautifies the pool water at night and also makes it safer for nocturnal swimming since bathers become plainly visible underwater. Above-pool lighting of the patio area around the pool cannot effectively accomplish either of these functions since the geometry of incident light rays causes most rays to be reflected back up at the pools surface. This causes the pool water to appear dark in contrast to the well lit patio area.

Conventional underwater pool lighting technology generally requires that a sealed lighting unit be submerged and built into the pool wall. These sealed units are expensive and generally suitable only for installation during construction of in-ground pools. Above ground pools cannot be easily fitted with such lighting due to the lack of structural support as well as the problems associated with sealing the joint between the light enclosure and the freestanding pool wall. Retrofitting lighting into an existing in-ground unlit pool is difficult since the wall of the pool must be pierced and underground cabling installed. Long term maintenance of existing underwater lighting systems becomes difficult as their water-tight gasket materials deteriorate.

My invention, the Portable Underwater Swimming Pool Light overcomes these problems by mounting the light element above the water line. No waterproof joints are required anywhere in the apparatus. Concentrated light is simply projected into the pool'water from above. Innovations are incorporated into the design to prevent the light from escaping above the water line as well as diffusing it evenly below the waterline thereby achieving the desired lighting effect. This design permits materials and construction techniques to be relatively inexpensive.

The invention may be broadly summarized as an underwater illumination apparatus for a swimming pool comprising a light transmission shaft having an upper and an open lower end, means for mounting the light transmission shaft to the swimming pool such that the light transmission shaft is located in a partially submerged position in the swimming pool and proximate a wall of the swimming pool with the upper end located above the pool waterline and the lower end located below the pool waterline, and a light source located above the waterline adjacent to and secured to the upper interior of the light transmission shaft such that it transmits light downward through the light transmission shaft and through an air/water boundary inside the light transmission shaft to the lower end of the light transmission shaft.

The apparatus is fastened temporarily to the edge of a pool and hangs into the water. Since the underwater portion of the apparatus' volume floods with the water, the unit has no positive buoyancy that would require a robust mounting bracket assembly. Its inherent portability permits easy installation and removal which improves the daytime appearance of the pool area. Its portability also permits easy maintenance of the apparatus or storage away from the elements during winter. The mounting hardware permits the light assembly to be bolted to either the deck surrounding an in-ground pool or else the upper wall brace of an above-ground pool. The portability thus also permits both in-ground pools and above-ground pools to be quickly and inexpensively retrofitted with underwater lighting.

According to another aspect, the invention may be summarized as an underwater illumination apparatus for a swimming pool comprising a light transmission shaft having an upper end and a lower end, means for mounting the light transmission shaft to the swimming pool such that the light transmission shaft is located substantially vertically in a partially submerged position in the swimming pool and proximate a wall of the swimming pool with the upper end located above the pool waterline and the lower nd located below the pool waterline, a light source located above the waterline adjacent to and secured to the upper interior of the light transmission shaft such that it transmits light downward through the light transmission shaft and means mounted in the lower end of the light transmission shaft for redirecting into the pool light transmitted through the light transmission shaft.

The invention will now be described in greater detail with reference to the accompanying drawings, in which.

Figure 1:
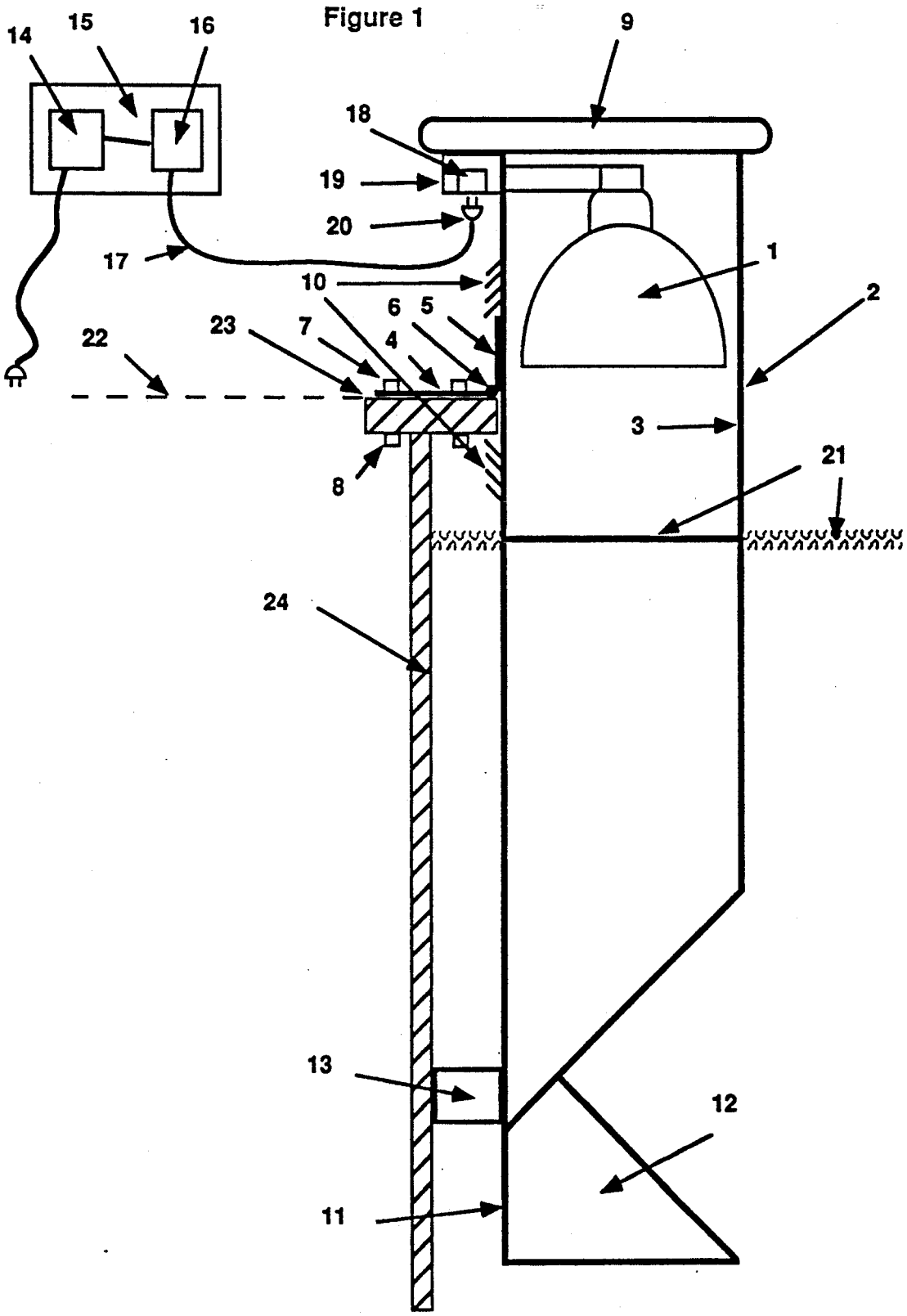
FIG. 1 is a cross-sectional side view of the pool light apparatus affixed in place to a swimming pool including a schematic drawing of the electrical wiring for the apparatus.

The invention takes the form of a downward focused high intensity light element 1 mounted above the waterline 21 of the swimming pool. This light element 1 is contained inside and mounted to the upper portion of a vertical light transmission shaft 2 which extends down below the waterline 21 of the swimming pool. The light element itself 1 is an approved commercially available outdoor flood-light assembly. This type of lighting unit is available from many manufacturers in a variety of sizes, shapes and wattages. Automobile headlights are also useful embodiments of the light element if low voltage to the apparatus is required as a redundant safety feature. The choice of standard lighting element chosen for use in the apparatus dictates the size, shape and cross-sectional proportions of the light shaft 2.

This light shaft 2 is substantially opaque to prevent light from escaping above the waterline 21 and thus detracting from the pool illumination effect. It can be fabricated from any metallic or plastic material that provides the necessary corrosion resistance, heat resistance, rigidity and light weight. It has a reflective inner surface 3 to maximize light transmission down the shaft.

The light shaft 2 has an "L" shaped bracket affixed to it which in its preferred embodiment, is a hinge comprised of a horizontal plate member 4, a vertical plate member 5 and a hinge joint 6 between the two plate members. This "L" shaped bracket affixes the light shaft to the upper inside wall of a swimming pool, hanging it vertically into the water with approximately the upper third of the shaft exposed above the waterline 21. The horizontal member of this bracket 4 affixes temporarily yet securely to the horizontal pool deck or patio surrounding an in-ground pool 22 or to the horizontal surface of the structural rim atop the free-standing wall of an above-ground pool 23. The vertical bracket member 5 is permanently bonded to the light shaft 2. The bracket hinge joining the two members 6 prevents the light shaft from applying a destructive bending moment to the apparatus and/or pool rim if a swimmer should erroneously try pulling the light shaft away from the pool wall 24.

When affixing the apparatus to an in-ground pool, the deck mounting bolts 7 for the horizontal member of the mounting bracket 4 screw into flush mounted threaded sockets 8 embedded in the pool deck 22. In their preferred embodiment these fasteners are commercially available threaded devices such as folding wing nuts or spring loaded quick-release fasteners. When mounting the apparatus onto an above-ground pool, the horizontal member of the mounting bracket 4 affixes to the upper rim of the free-standing pool wall 23 using the same quick-release fasteners 7 and threaded sockets 8; however in this case the sockets are employed as free turning bolts on the underside of the pool rim 23 rather than being permanently embedded into the pool deck 22. The dimensions of the plate which forms the horizontal bracket member 4 are small enough that it doesn't overhang the horizontal surface of the structural pool rim of an above-ground pool 23 (generally less than 6 inches). This small surface dimension is somewhat of a safety feature in that it encourages users to use the supplied bolts 7 and sockets 8 to secure the apparatus firmly to the pool structure 22 or 23 rather than attempting to secure it in an unsafe fashion with the weight of some pool-side object placed on the surface of the horizontal bracket 4. Both the in-ground and above-ground mounting modes permit rapid installation and removal of the apparatus yet prevent it from being inadvertently knocked or pulled into the pool.

The top of the light shaft is enclosed by a removable top 9 which prevents light from escaping above the waterline of the pool 21. It also permits access to the lighting element 1 for maintenance as well as affording it an extra degree of splash protection. Ventilation louvers 10 on the side of the light shaft nearest the pool wall allow cool air into the light shaft just above the waterline and permit hot air to rise, cool the light element 1 and then exit the light shaft near the removable top 9. These louvers also vent the shaft to atmospheric pressure thus allowing the natural water level of the pool to be established inside the shaft. This eliminates any positive buoyancy of the apparatus which would prevent its weight from causing it to hang vertically into the pool due to gravity alone.

The light shaft extends down below the waterline 21 and is open at the bottom. In one of its preferred embodiments the opening at the bottom of the light shaft is inclined downwards and away from the pool wall at approximately 45° to the vertical. This downward sloping exit maximizes the light that is projected out into the pool. The surface of the light shaft closest to the pool wall extends down below the shaft exit to form a support plate 11 to which a light diffuser 12 is affixed.

Figure 2:
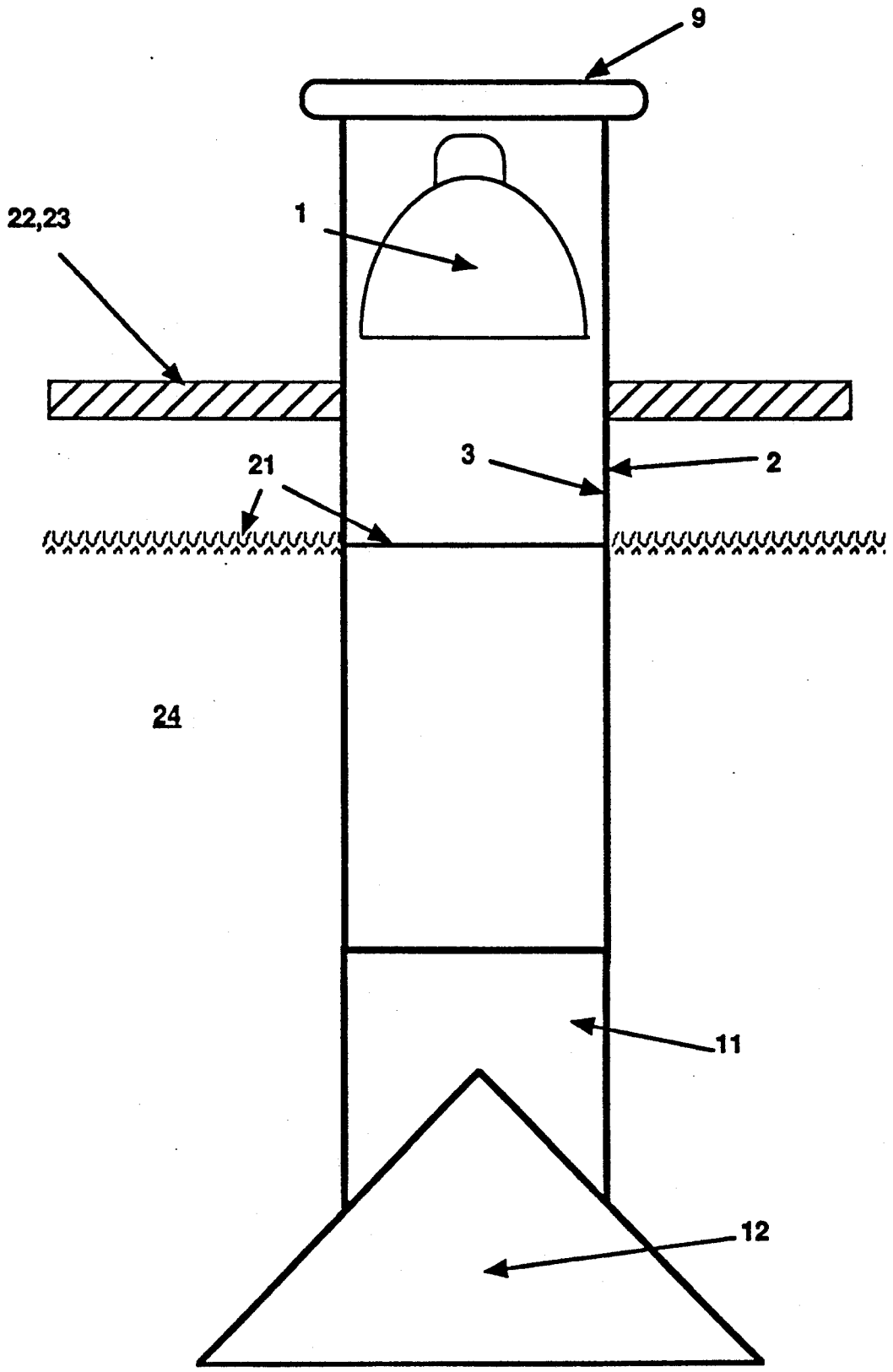
FIG. 2 is a front view of the apparatus seen from within the pool.

The light diffuser 12 is comprised of a reflective surface suspended below the exit of the light shaft 2 and inclined at approximately 45° to its vertical axis. Vertical light rays exiting the light shaft are thus reflected horizontally by the light diffuser to illuminate the volume of water in the pool. In one preferred embodiment depicted in FIGS. 1 and 2, the light diffuser 12 is a vertically bisected, cone which transforms the vertical light beam into a horizontal fan of illumination.

Figure 3:
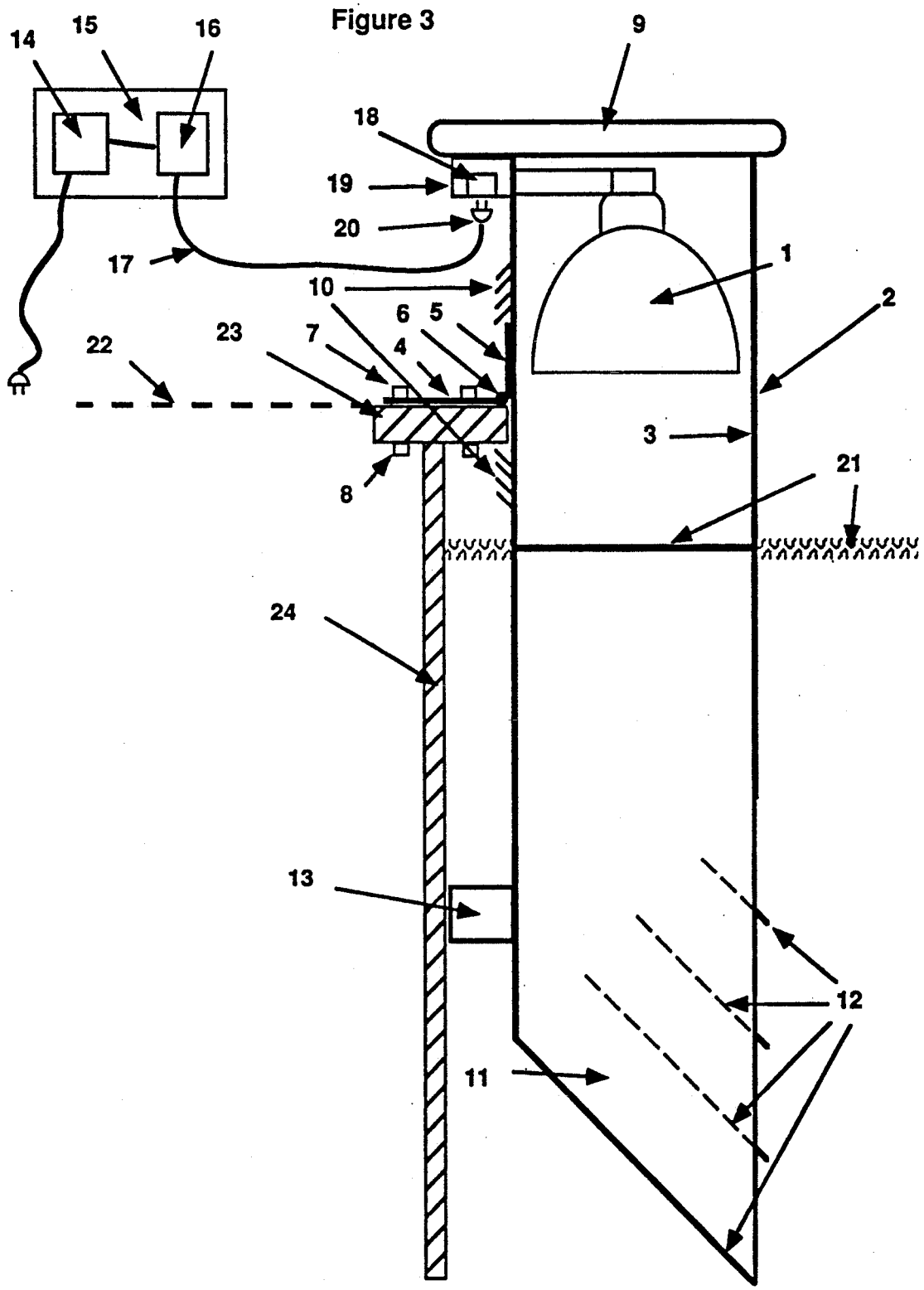
FIG. 3 is a side view of the invention showing an alternate embodiment of the light diffuser assembly.

A multi-faceted light diffuser as depicted in FIG. 3 is also a preferred embodiment. This embodiment is comprised of multiple flat rectangular light diffuser plates 12 affixed within the light shaft exit. In this embodiment the support plate 11 for the light diffuser elements 12 is formed by side extensions of the light transmission shaft 2 rather than the back as in the previous embodiment. Its light shaft exit is on the side of the light transmission shaft 2 facing into the pool rather than inclined downward as in the previous embodiment. The plane of each of the reflective light diffusers 12 is inclined at approximately 45° to the axis of the light shaft 2 such that vertical light rays striking its surface are reflected into the horizontal plane. The multiple diffuser elements 12 are affixed one above the other in the light shaft exit with smaller elements situated above increasingly larger elements. Each of the reflecting elements 12 is of increasing width such that lower elements will intercept light rays that have missed being reflected by the element above it.

The light diffuser assembly 12 can be fabricated from any metallic or plastic material that provides the necessary corrosion resistance, rigidity, reflectivity and light weight. A spacer block 13 is affixed to the back of light transmission shaft 2 near its lower edge to support the shaft away from the pool wall and thus maintain it in a vertical position. The spacer is made of an appropriately smooth and resilient material so that no puncture hazard exists when the apparatus is used in pools lined with a vinyl membrane.

Protection against electrical shock hazards is an extremely important consideration which is addressed by three different design features. The first level of protection is achieved due to the inherent safety of mounting the light element 1 above the surface of the pool 21 rather than under it. Since the apparatus is securely fastened to the pool structure, no electrical element can become immersed in the pool to create a potential shock hazard. The light element 1 employed in the apparatus is also a weather-tight unit electrically approved "for use in wet areas". Furthermore, the light shaft enclosure affords redundant splash protection for the lighting unit 1. Also, the stilling well effect of the light shaft 2 calms vertical wave action from the pool and thus affords redundant vertical splash protection for the approved lighting unit 1.

The second level of electrical safety is achieved by means of either an approved Ground Fault Circuit Interrupter (GFCI) 14 or a low voltage power transformer 14 housed inside a separate power supply box 15 together with a power switch for the light 16. This assembly is situated at a safe distance outside the pool area. Electrical input to the GFCI or low voltage transformer is standard household line voltage (110 v. in North America). Its GFCI protected or low voltage output is transmitted to the light apparatus via a power cable 17 which traverses the patio area surrounding the pool.

The third level of electrical safety is achieved by means of a non-standard electrical socket 18 located on the light apparatus within an approved electrical junction box 19. The plug and socket are located under the horizontal extension of the top 9 to afford some degree of splash protection and their mating surfaces are gasketed to further inhibit water infiltration. The configuration of the electrical contacts in the socket are physically incompatible with standard household power supply cables. A matching non-standard electrical plug 20 on the power cable 17 is required to connect the GFCI protected or low voltage power source 15 to the light element. This prevents users from inadvertently connecting the apparatus to an unprotected or high voltage power source.

I claim:

1. An underwater illumination apparatus for a swimming pool comprising a light transmission shaft having an upper end and an open lower end, means for mounting the light transmission shaft to the swimming pool such that the light transmission shaft is located in a partially submerged position in the swimming pool and proximate a wall of the swimming pool with the upper end located above the pool waterline and the lower end located below the pool waterline, and a light source located above the waterline adjacent to and secured to the upper interior of the light transmission shaft such that it transmits light downward through the light transmission shaft and through an air/water boundary inside the light transmission shaft to the lower end of the light transmission shaft.

2. An apparatus according to claim 1 in which the light transmission shaft is constructed of a substantially opaque material.

3. An apparatus according to claim 1 in which the light transmission shaft is vented to atmospheric pressure.

4. An apparatus according to claim 1 in which the means for mounting is arranged to mount the light transmission shaft in a substantially vertical position and further comprising a reflective light diffuser mounted adjacent the lower end of the light transmission shaft whereby a vertical light beam projected down through the air/water boundary inside the light shaft is reflected generally horizontally into the pool.

5. An apparatus according to claim 1 in which the means for mounting is a hinged mounting bracket arranged to removably mount the apparatus either to the deck surrounding an in-ground pool or to the rim atop the wall of an above-ground pool.

6. An apparatus according to claim 1 in which swimmers are protected from shock hazard by means of a standard Ground Fault Circuit Interrupter GFCI or stepdown transformer which is located at a safe distance from the light apparatus but connected to it via a cable terminating in a connector whose three contact prongs and sockets are incompatible with standard household electrical supply connectors.

7. An apparatus according to claim 1 in which the light transmission shaft has a removable top and a light reflective inner surface.

8. An apparatus according to claim 1 in which the means for mounting is arranged to mount the light transmission shaft adjacent to and substantially parallel to at least an upper portion of an inside wall of the pool whereby the light transmission shaft is substantially vertical.

9. An apparatus according to claim 8 in which the means for mounting comprises a hinged mounting bracket for securing the light transmission shaft to the deck of an in-ground pool or to the rim of an above-ground pool and a spacer located near the lower end of the light transmission shaft for engagement with the pool wall.

10. An apparatus according to claim 9 in which the light transmission shaft is vented in an upper portion thereof whereby in use the upper portion is vented to ambient atmosphere.

11. An apparatus according to claim 10 in which a reflective light diffuser is located adjacent the lower end of the light transmission shaft whereby in use light transmitted down the shaft is reflected outwardly from the light transmission shaft and into the pool.

12. An apparatus according to claim 11 in which the light transmission shaft has a removable top which encloses the light source.

13. An apparatus according to claim 1 in which the light transmission shaft has a light reflective inner surface.

14. An apparatus according to claim 1 further comprising means mounted adjacent the lower end of the light transmission shaft for redirecting into the pool light transmitted through the light transmission shaft.

* * * * *